United States Patent [19]

Dudheker et al.

[11] 4,052,141

[45] Oct. 4, 1977

[54] ATMOSPHERIC BURNER FOR HEATING FURNACES

[75] Inventors: Jay Dudheker, Holland; Charles E. Isaacson, Hamilton, both of Mich.

[73] Assignee: Lear Siegler, Inc., Holland, Mich.

[21] Appl. No.: 606,703

[22] Filed: Aug. 21, 1975

[51] Int. Cl.[2] ..... F23D 11/02; F23C 5/02

[52] U.S. Cl. ..... 431/167; 431/181; 431/202; 431/347

[58] Field of Search ..... 431/347, 348, 181, 354, 431/167, 202; 239/427.3, 428.5; 48/180 F; 60/39.23

[56] References Cited

U.S. PATENT DOCUMENTS

| | | | |
|---|---|---|---|
| 1,666,747 | 4/1928 | McDonald | 431/189 |
| 1,809,425 | 6/1931 | Roberts | 48/180 F |
| 1,853,277 | 4/1932 | Johnston | 239/427.3 |
| 2,117,270 | 5/1938 | Bloom | 431/354 |
| 3,684,424 | 8/1972 | Zink et al. | 431/167 |
| 3,693,887 | 9/1972 | Brodlin et al. | 431/347 |
| 3,711,243 | 1/1973 | Zink et al. | 431/181 |
| 3,754,853 | 8/1973 | Braucksiek et al. | 431/347 |
| 3,940,234 | 2/1976 | Reed et al. | 431/348 |
| 3,948,593 | 4/1976 | Moore et al. | 431/347 |

*Primary Examiner*—Carlton R. Croyle
*Assistant Examiner*—Thomas I. Ross
*Attorney, Agent, or Firm*—Price, Heneveld, Huizenga & Cooper

[57] ABSTRACT

An inshot, atmospheric burner assembly is provided for hot air furnaces including a frame supporting a venturi assembly, an adjustable secondary air shutter and a circular target or flame spreader. The flame spreader is positioned adjacent the outlet of the venturi assembly. An orifice holder extends through the base of the frame and adjustably carries a primary air shutter.

11 Claims, 4 Drawing Figures

ATMOSPHERIC BURNER FOR HEATING FURNACES

BACKGROUND OF THE INVENTION

This invention relates to hot air furnaces and more particularly it concerns a unique atmospheric gas burner for a forced, hot air furnace having the qualities of compact size, light weight, high efficiency, ease of manufacture and relative low cost.

Hot air, forced draft furnaces employing various types of oil or gas burners are well known in the prior art. For example, U.S. Pat. No. 3,516,397 discloses a forced air furnace having a heat exchanger section, a combustion chamber, a burner section, and a flue gas exit section. The combustion chamber shown in this patent includes a wall having an arperturetherein for reception of an oil or gas power burner.

Oil or gas power burners of the type contemplated to be employed with the forced air furnace of the above-noted patent, generally include a blower driven by an electrical motor to supply combustion air to the burner. A gas control valve/regulator is required for controlling the amount of gas supplied to the burner. A control system adapted to regulate the operation of the gas control valve and blower in conjunction with a thermostat is also necessary.

While these types of power burners function efficiently, the operation is relatively noisy. Further, these units are heavy, bulky in size, and expensive to manufacture due in part to the use of the electric motor driven blower and related control systems.

Forced air furnaces have been proposed which employ atmospheric burners. The burners employed have generally been of the upshot type. While the use of an upshot type atmospheric gas burner results in the elimination of the motor and blower noise associated with a power burner and the elimination of an electrical supply for burner operation, the heat exchange area of presently available forced air furnaces must be increased approximately one third over that employed with forced air furnaces using a power burner.

Inshot atmospheric burners, although highly efficient, have not been employed with forced air furnaces of the type disclosed in the above-noted patent. Due to their flame pattern, straight inshot atmospheric burner necessitate an increase in the combustion chamber size of the forced air furnace to prevent flame impingement on the walls of the combustion chamber. The flame pattern produced by conventional inshot atmospheric burners does not result in the most efficient exchange of heat to the forced air supply of the furnace. Further, conventional inshot atmospheric burners are generally formed from cast iron, resulting in relatively high weight and thereby requiring a fairly substantial mounting structure.

SUMMARY OF THE INVENTION

In accordance with the present invention, an improved inshot atmospheric burner assembly is provided for use with a conventional forced air furnace resulting in decreased weight, decreased furnace heat exchange area when compared with a furnace employing an upshot atmospheric burner, as well as relatively low cost and ease of manufacture. Essentially, the improved inshot burner includes a venturi assembly carried by a U-shaped frame adapted to be mounted directly to the pouch tube of a conventional forced air furnace. The burner assembly further includes an orifice structure, an adjustable primary air shutter and an adjustable secondary air shutter. A perforated target having an angled portion is supported by the U-shaped frame and positioned in front of the outlet of the venturi. This arrangement results in the formation of a ball-shaped flame pattern centrally located within a conventional combustion chamber. Provision is further made for supporting a conventional pilot light, thermocouple and gas valve arrangement.

Among the objects of the present invention, therefore, are: the provision of an improved inshot atmospheric burner assembly capable of being readily adapted to a conventional forced air furnace; the provision of an inshot atmospheric burner assembly which is simple, lightweight, compact, easily manufactured at a relatively low cost; and the provision of an improved low cost atmospheric burner of the type referred to by which the problems heretofor experienced with forced air furnaces employing atmospheric or power burners are substantially alleviated.

DETAILED DESCRIPTION OF THE PREFERRED EMBODIMENT

Figure 1:
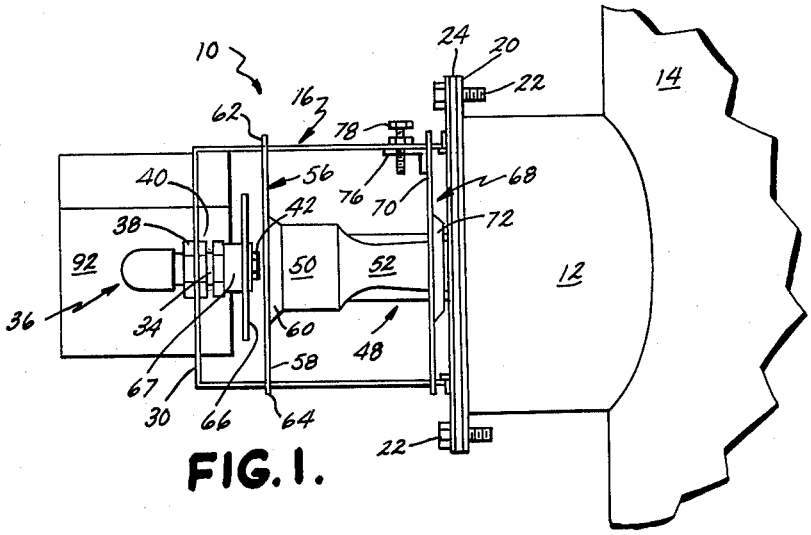
FIG. 1 is a fragmentary view in side elevation of the novel atmospheric burner assembly in combination with a combustion chamber of a forced air furnace.

With reference to the drawings, FIG. 1 illustrates the novel inshot burner assembly, generally designated 10, attached to a pouch tube 12 of a forced air furnace combustion chamber 14. The burner assembly includes an open sided U-shaped burner frame 16 to which is attached an annular, pouch tube collar 18. The collar 18 is formed with suitable apertures and is adapted to support and connect the burner assembly 10 to a pouch tube flange 20 through the use of bolts 22. A gasket 24, formed of heat resistant material, is sandwiched between the annular collar 18 and the pouch tube flange 20.

Figure 2:
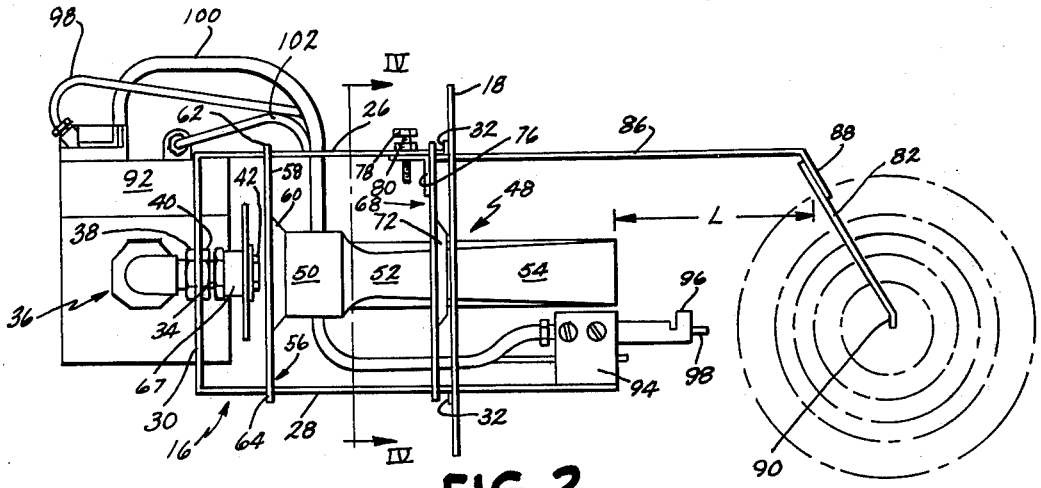
FIG. 2 is a side-elevational view of the novel burner assembly.
Figure 3:
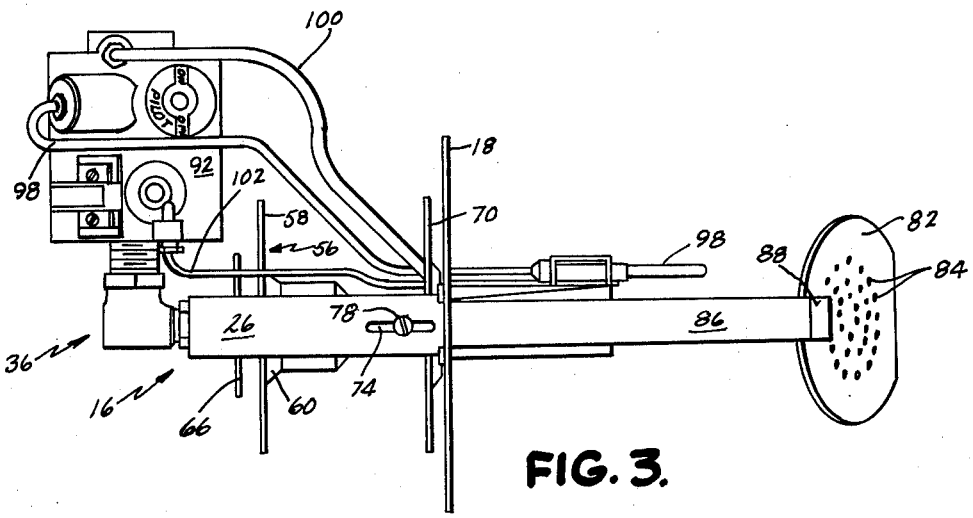
FIG. 3 is a plan view thereof.

As best seen in FIGS. 2 and 3, the burner frame 16 includes legs 26 and 28 formed integral with a base portion 30 all formed from flat stock to thereby define an open sided support. It will be noted that leg 26 is shorter than leg 28 and both legs are formed with upstanding tabs or projections 32. These tabs function as weld and positioning points for connecting the annular collar 18 to the burner frame 16.

The base portion 30 of the burner frame 16 is formed with a centrally located aperture through which the threaded portion 34 of an orifice elbow 36 is disposed. The base 30 is adjustably secured to the orifice elbow 36 by a pair of lock nuts 38 and 40. An orifice 42 is threadably secured within the outlet end of the orifice elbow 36.

A venturi assembly generally designated 48 includes an intake portion 50 tapering down to a venturi throat 52 and followed by a diverging outlet portion 54. A venturi holder 56 is welded or otherwise suitably attached or formed as part of the inlet end of the venturi 50. The venturi holder has an annular portion 58 and a frusto-conical portion 60 to which the venturi inlet 50 is attached. The annular portion 58 of the venturi holder 56 is notched or grooved at diametrically opposed positions 62 and 64. The notches are dimensioned to receive the legs 26 and 28 of the burner frame 16, thereby, attaching the venturi assembly 48 to the frame member 16.

A primary air shutter 66 having an annular or ring-like shape is mounted concentric with an internally threaded hub 67. The hub 67 is mounted on threaded portion 34 of the orifice elbow 36 and is secured by a lock nut. By virtue of the mounting arrangement of the orifice hub, the amount of primary combustion air may be adjusted by rotating the hub and moving the primary air shutter 66 either away from the venturi holder 56 to thereby increase the primary air flow or closer to the venturi holder 56 to thereby decrease the amount of primary air flow.

A secondary air shutter 68 including an annular ring 70 and a frusto-conical portion 72 is adjustably supported by leg 26 relative to the annular support collar 18. The leg 26 is formed with an elongated slot 74 and the secondary air shutter is attached to a right angle bracket 76. A self-threading screw or other suitable fastener 78 extends through a lock nut 80, elongated slot 74 and the right angle bracket 76 to thereby provide an adjustable mounting arrangment for the secondary air shutter 68.

The initial positioning of the primary air shutter 66 and the secondary air shutter 68 is dependent upon the size of the orifice 42 and the type of gas employed in the furnace system. The positioning is preferably set at the point of manufacture to obtain the maximum efficiency from the burner assembly.

A target or flame spreader 82 which may have perforations 84 formed therein is supported by an arm 86. The target arm 86 is weldably attached at one end to the under side of leg of the support frame 16. The opposite end 88 of the target arm is bent at an angle relative to the centerline of the venturi 48. The target 82 is weldably attached or otherwise suitably secured to this end of the target arm. A portion 90 of the target diametrically opposite from the target arm 86 is angled relative to the bent portion 88 of the target arm. This latter feature of the target serves to spread the flame at the target area creating a flame pattern having a spherical or ball-like shape, schematically illustrated in FIG. 2.

The distance L from the outlet of the venturi 48 to the target 82 and the angle of the target arm portion 88 is critical in forming the ball-shaped flame pattern. These dimensions will of course vary depending upon the overall size and output of the burner assembly. Further, these dimensions can only be determined through an emperical process.

The angle of the target portion 90 does not appear critical to the overall operation of the burner. An angle of 30° relative to the main portion of the target has been found to be satisfactory.

Therefore, the overall burner assembly including the target arm results in accurate control and placement of the flame pattern to prevent impingement of the flame on the walls of the combustion chamber 14 as well as permitting even distribution of the heat output of the burner to the heat exchange section (not shown) of the forced air furnace.

The burner assembly is connected to a source of gas through a gas control valve 92 which is threadably connected to the inlet of the orifice elbow 36. A bracket 94 is disposed on the end of leg 28 and serves as a support point for a pilot assembly 96 and the end of a thermocouple 98. The pilot assembly 96 is connected to the gas control valve 92 through a gas tube 100 and the gas control valve is vented by a vent line 102 which terminates adjacent the pilot light assembly.

Figure 4:
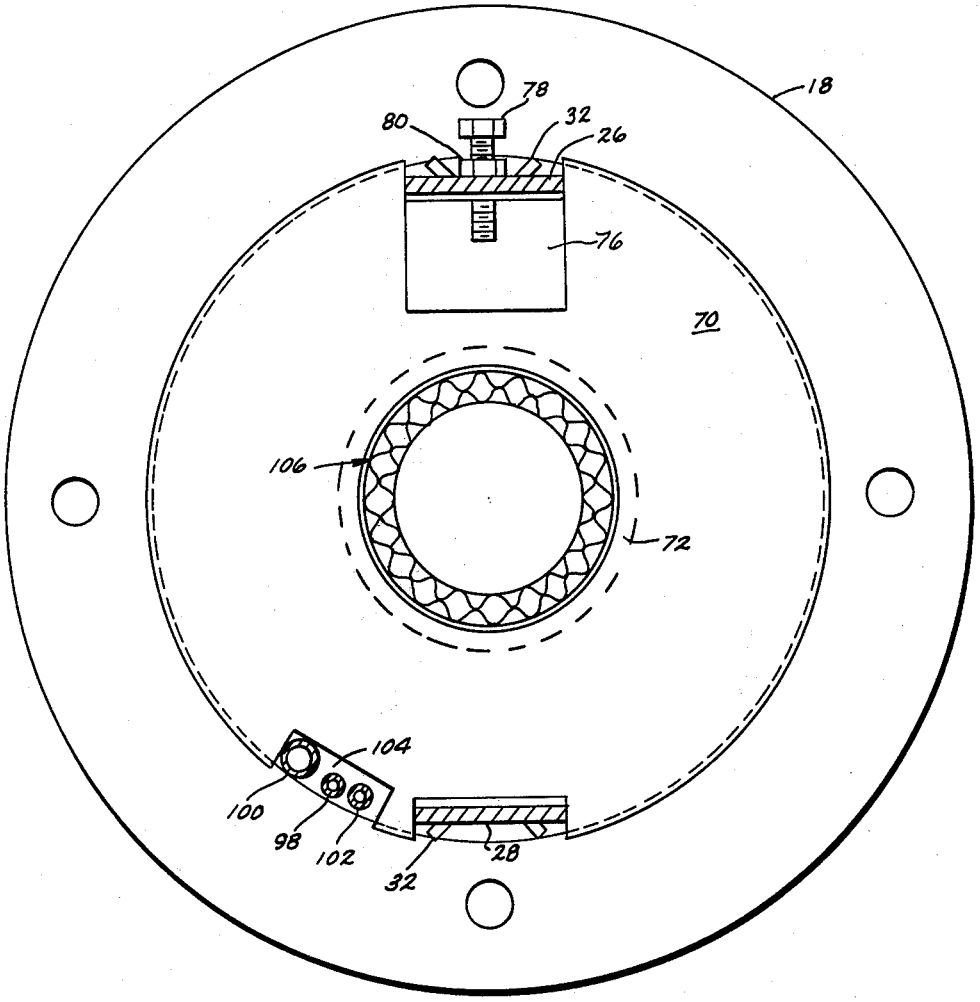
FIG. 4 is a cross section taken on line IV—IV of FIG. 2.

The secondary air shutter 68, as best seen in FIG. 4, is formed with a notch 104 through which the thermocouple 98, the gas tube 100 and the vent line 102 pass. Also, it should be noted that a ribbon element 106 is positioned within the outlet of the venturi 54. This ribbon element functions to eliminate flashback and carbon deposits should propane gas be employed with the burner assembly. The ribbon also serves to more efficiently mix the gas/primary air mixture to thereby obtain better and more efficient combustion.

In manufacturing the burner subassembly, the venturi 48, the burner frame 16, the pouch tube collar 18, the primary air shutter 66, the secondary air shutter 68, pilot bracket 94 and secondary air shutter bracket 76 are readily fabricated from sheet metal. This results in an easily manufactured burner of light weight, when compared with a cast iron inshot atmospheric burner having reduced cost of manufacture.

In assembling the various components of the subject burner, the venturi 48 and holder 56 are first positioned on the burner frame 16. The secondary air shutter assembly including air shutter 68 and bracket 76 is then positioned about the venturi 48 on the frame 16. Next, the target arm 86 and the pouch tube collar 18 are welded to the frame assembly. The target 82, pilot bracket 94, self-threading screw 78 and lock nut 80 may then be attached.

Thus, it will be appreciated that the present invention provides a low cost, inshot atmospheric burner having the qualities of compact size, low weight, ease of manufacture and which is readily adaptable to existing forced air furnaces. The primary air shutter and secondary air shutter arrangements provide a full range of adjustability so that optimum combustion and therefore maximum efficiency may be obtained. Also, the target or flame spreader results in the formation of a ball-shaped or spherical flame pattern (See FIG. 2) which will be centrally positioned within the combustion chamber of the hot air furnace. As expressly intended, therefore, the foregoing description is illustrative of the preferred embodiment only and is not to be considered as limiting. The true spirit and scope of the present invention will be determined by reference to the appended claims.

The embodiments of the invention in which an exclusive property or privilege is claimed are defined as follows:

1. An inshot atmospheric gas burner assembly, comprising:

an orifice holder;

an open sided burner frame positioned on said orifice holder;

a venturi assembly having an inlet and an outlet supported by said burner frame in front of said orifice holder, the centerline of said venturi assembly being coincident with the centerline of said orifice holder;

a primary air shutter assembly adjustably disposed on said orifice holder for movement towards and away from said venturi assembly inlet to thereby define an adjustable primary air passage;

an annular collar positioned around and attached to said burner frame and adapted to attach the burner frame to a furnace;

a secondary air shutter assembly adjustably supported on said burner frame between said venturi assembly inlet and said annular collar and including an annular ring concentrically positioned around said venturi assembly adjacent said annular collar to thereby define an adjustable secondary air passage with said annular collar; and a target assembly supported by said burner frame in line with and spaced from the outlet of said venturi assembly and adapted to be impinged upon by the flame from the burner assembly.

2. An inshot atmospheric burner assembly as defined by claim 1, wherein said target assembly comprises:

a target arm rigidly secured at one end to said burner frame and having a portion angled with respect to the centerline of said venturi assembly at the other end; and a circular generally planar flame spreader attached to said angled portion of said target arm and positioned spaced from and at an angle to the outlet of said venturi assembly.

3. An inshot atmospheric gas burner assembly, comprising:

an orifice holder;

an open sided burner frame positioned on said orifice holder;

a venturi assembly having an inlet and an outlet supported by said burner frame in front of said orifice holder, the centerline of said venturi assembly being coincident with the centerline of said orifice holder;

a primary air shutter assembly adjustably disposed on said orifice holder for movement towards and away from said venturi assembly inlet to thereby define an adjustable primary air passage;

an annular collar positioned around and attached to said burner frame and adapted to attach the burner frame to a furnace;

a secondary air shutter assembly adjustably supported on said burner frame between said venturi assembly inlet and said annular collar and including an annular ring concentrically positioned around said venturi assembly adjacent said annular collar to thereby define an adjustable secondary air passage with said annular collar;

a target arm rigidly secured at one end to said burner frame and having a portion angled with respect to the centerline of said venturi assembly at the other end;

a circular generally planar flame spreader attached to said angled portion of said target arm and positioned spaced from and at an angle to the outlet of said venturi assembly; and said circular flame spreader having a plurality of perforations formed therein.

4. An inshot atmospheric burner as defined by claim 2, wherein said circular flame spreader further includes an angled portion formed at a position diametrically opposed from the attachment point of said flame spreader to said target arm.

5. An inshot atmospheric burner as defined by claim 3, wherein said circular flame spreader includes an angled portion at a position diametrically opposed from the attachment point of said flame spreader to said target arm.

6. An inshot atmospheric burner assembly, comprising:

an orifice holder;

a burner frame positioned on said orifice holder;

a venturi assembly having an inlet and an outlet supported by said burner frame in front of said orifice holder, the centerline of said venturi assembly being coincident with the centerline of said orifice holder;

a primary air shutter assembly adjustably disposed on said orifice holder for movement towards and away from said venturi assembly inlet to thereby define an adjustable primary air passage;

an annular collar positioned around and attached to said burner frame and adapted to attach the burner frame to a furnace;

a secondary air shutter assembly adjustably supported on said burner frame between said venturi assembly inlet and said annular collar and including an annular ring concentrically positioned around said venturi assembly adjacent said annular collar to thereby define an adjustable secondary air passage;

a target assembly supported by said burner frame in line with and spaced from the outlet of said venturi assembly and adapted to be impinged upon by the flame from the burner assembly and, wherein said burner frame is generally U-shaped and includes a base portion and leg portions, said base portion having an aperture formed therein, said frame adjustably disposed on said orifice holder at said base aperture thereby permitting said burner frame to be adjustably positioned on said orifice holder.

7. An inshot, atmospheric burner assembly as defined by claim 6, wherein said primary air shutter assembly includes a hub adjustably disposed on said orifice holder; and an annular ring attached to said hub.

8. An inshot, atmospheric burner assembly as defined by claim 7, wherein said secondary air shutter assembly further includes a frusto-conical portion attached to said annular ring.

9. An inshot, atmospheric burner assembly as defined by claim 8, wherein said target assembly includes a target arm, one end of which is secured to one of said leg portions, and the other end of which is angled relative to said frame; and a circular flame spreader attached to said angled portion of said target arm.

10. An inshot, atmospheric burner assembly as defined by claim 9, wherein said circular flame spreader includes an angled portion at a position diametrically opposed from the attachment point of said flame spreader to said target arm.

11. An inshot, atmospheric burner assembly as defined by claim 10 further including a ribbon element disposed within the outlet of said venturi assembly.

* * * * *